US007946650B2

(12) United States Patent
Gillett

(10) Patent No.: US 7,946,650 B2
(45) Date of Patent: May 24, 2011

(54) INFANT BOUNCER

(75) Inventor: Sharon A. Gillett, Taipei (TW)

(73) Assignee: Wonderland Nurserygoods Co., Ltd., Neihu, Taipei (TW)

( * ) Notice: Subject to any disclaimer, the term of this patent is extended or adjusted under 35 U.S.C. 154(b) by 66 days.

(21) Appl. No.: 12/464,882

(22) Filed: May 13, 2009

(65) Prior Publication Data

US 2009/0284058 A1 Nov. 19, 2009

Related U.S. Application Data

(60) Provisional application No. 61/127,935, filed on May 16, 2008.

(51) Int. Cl.
*A47C 3/02* (2006.01)

(52) U.S. Cl. ..... 297/258.1; 297/DIG. 11

(58) Field of Classification Search ..... 297/268.1, 297/258.1, 296, 297, 5, 325, 273, 274, DIG. 11, 297/280, 281, 282, 275, 344.1; 472/103, 472/104, 105, 135; 267/131, 133
See application file for complete search history.

(56) References Cited

U.S. PATENT DOCUMENTS

| | | | | | |
|---|---|---|---|---|---|
| 1,428,039 | A | * | 9/1922 | Kratz | 297/130 |
| 2,460,308 | A | * | 2/1949 | Pribil | 4/572.1 |
| 2,715,935 | A | * | 8/1955 | Berry, Jr. | 297/285 |
| 3,692,359 | A | | 9/1972 | Boucher | |
| 5,203,611 | A | | 4/1993 | Greenwood | |
| 5,207,478 | A | * | 5/1993 | Freese et al. | 297/296 |
| 5,499,949 | A | | 3/1996 | Heubl | |
| 5,690,383 | A | | 11/1997 | Meeker | |
| 6,053,816 | A | * | 4/2000 | Immel | 472/103 |
| 7,727,076 | B2 | * | 6/2010 | Bapst et al. | 472/103 |
| 2007/0007804 | A1 | | 1/2007 | Pemberton | |

FOREIGN PATENT DOCUMENTS

| | | | | |
|---|---|---|---|---|
| CN | 2891849 | Y | | 4/2007 |
| CN | 200956947 | Y | | 10/2007 |
| CN | 201119651 | Y | | 9/2008 |
| DE | 3427 755 | A1 | | 1/1986 |
| GB | 2117257 | A | * | 10/1983 |
| JP | 200580894 | A | | 3/2005 |
| WO | 2006096712 | A2 | | 9/2006 |

* cited by examiner

*Primary Examiner* — Milton Nelson, Jr.
(74) *Attorney, Agent, or Firm* — Winston Hsu; Scott Margo

(57) ABSTRACT

An infant bouncer includes a seat, a support frame, a flexible part, and a positioning structure. The support frame is used for supporting the seat. The flexible part is disposed on the support frame. The positioning structure connects the seat and the flexible part so as to position the seat relative to the support frame.

26 Claims, 7 Drawing Sheets

INFANT BOUNCER

CROSS REFERENCE TO RELATED APPLICATIONS

This application claims the benefit of U.S. Provisional Application No. 61/127,935, filed on May 16, 2008 and entitled "Soothing Seat Bouncers" the contents of which are incorporated herein by reference.

BACKGROUND OF THE INVENTION

1. Field of the Invention

The present invention relates to an infant bouncer, and more specifically, to an infant bouncer with flexible parts.

2. Description of the Prior Art

In general, the bouncing motion has become the main characteristic for what is commonly known as an infant bouncer. A common infant bouncer includes a seat, a support frame offering bouncing function disposed under the seat for supporting the seat. Common mechanisms are applied to the support frame, such as elastic wire frames or springs to attain the bouncing function.

However, such mechanisms require a sophisticated structural design and precise manufacturing for enabling bouncing motion of the seat relative to the support frame. Therefore, the manufacturing process of the bouncing structure is strenuous and time-consuming.

Furthermore, the traditional structure can only offer upward and downward bouncing movement. Thus, how to manufacture an infant bouncer with a simple bouncing structure should be a critical issue.

SUMMARY OF THE INVENTION

The present invention provides an infant bouncer comprising a seat; a support frame for supporting the seat; a flexible part disposed on the support frame; and a positioning structure connecting the seat and the flexible part so as to position the seat relative to the support frame.

The present invention further provides an infant bouncer comprising a seat; a support frame for supporting the seat; and a flexible part disposed on the support frame, wherein the seat is suspended from the flexible part.

These and other objectives of the present invention will no doubt become obvious to those of ordinary skill in the art after reading the following detailed description of the preferred embodiment that is illustrated in the various figures and drawings.

DETAILED DESCRIPTION

Further description for an infant bouncer with flexible parts according to the present invention is provided as follows with reference to the attached drawings.

Figure 1:
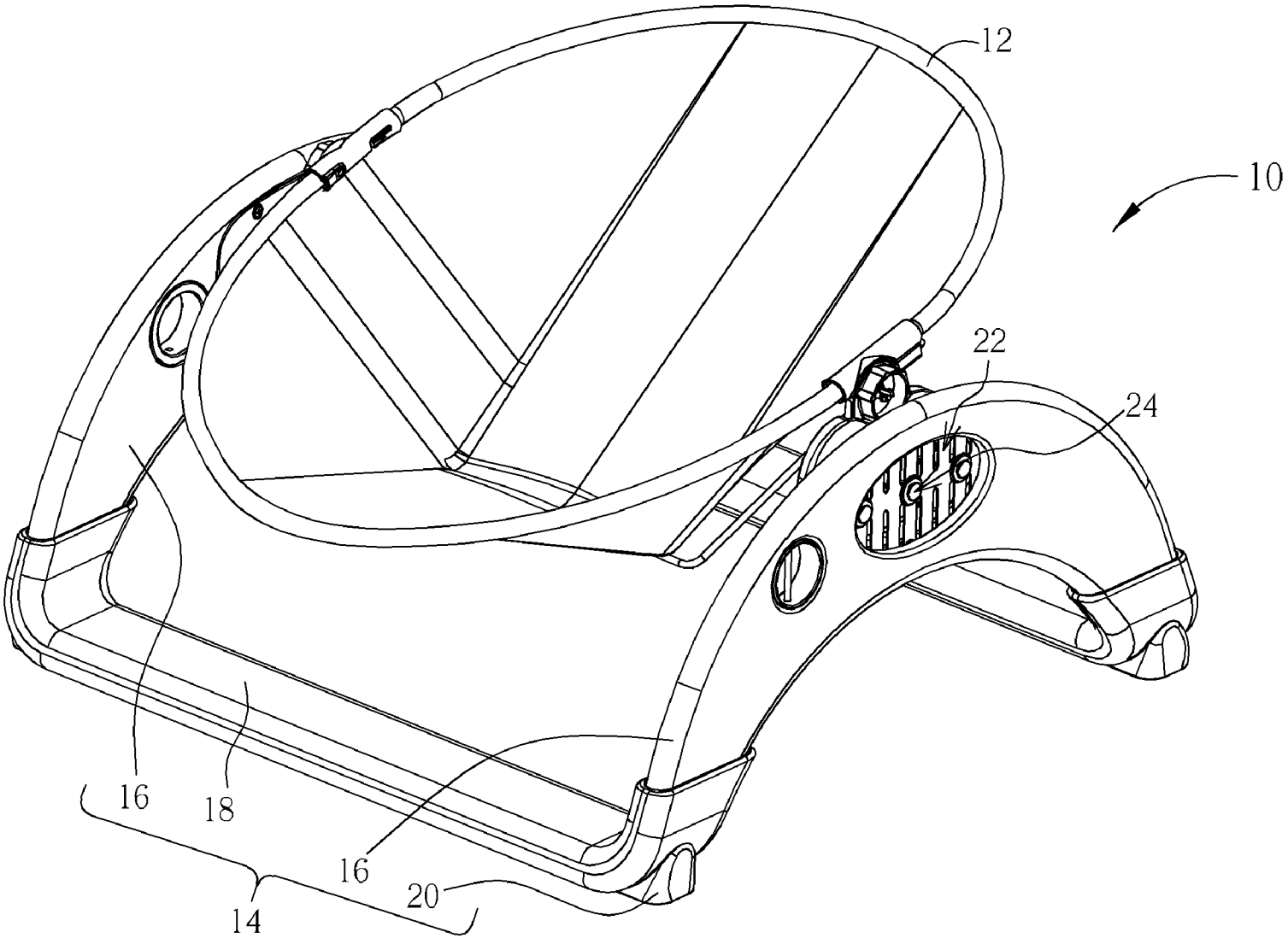
FIG. 1 is an assembly diagram of an infant bouncer according to a first preferred embodiment of the present invention.

Please refer to FIG. 1, which is an assembly diagram of an infant bouncer 10 according to a first preferred embodiment of the present invention. The infant bouncer 10 includes a seat 12 and a support frame 14. The support frame 14 is disposed for supporting the seat 12. In this embodiment, the support frame 14 includes two support feet 16, at least one cross support bases 18 (two shown in FIG. 1), and at least one skidproof pad 20 (four used in this embodiment). The two support feet 16 are disposed at two sides of the seat 12, respectively. Each support foot 16 is preferably made of plywood material, but the invention is not limited thereto, meaning that log, plastic and other solid materials are also available.

Figure 2:
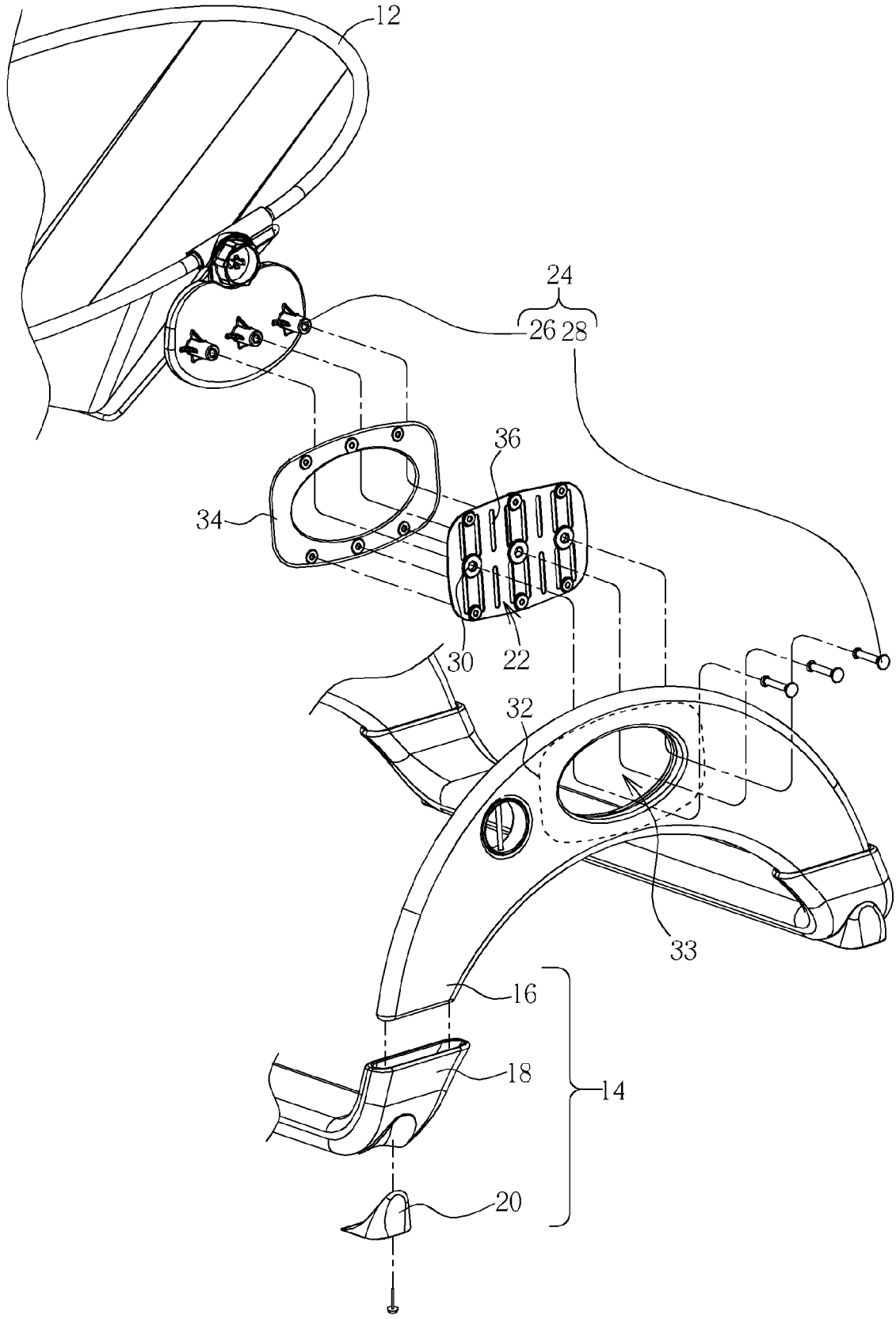
FIG. 2 is a partial exploded diagram of the infant bouncer in FIG. 1 according to the first preferred embodiment of the present invention.

As shown in FIG. 1, each cross support base 18 is connected to the two support feet 16, and each skidproof pad 20 is disposed under the corresponding cross support base 18. Structure for connecting the skidproof pad 20 to the cross support base 18 is commonly utilized in the prior art. For example, each skidproof pad 20 can be fixed to the cross support base 18 and the support foot 16 by screw as shown in FIG. 2, which is a partial exploded diagram of the infant bouncer 10 in FIG. 1 according to the first preferred embodiment of the present invention. Both the cross support base 18 and the skidproof pad 20 are preferably made of plastic material. In summary, in this embodiment, the support frame 14 utilizes assembly of the two support feet 16, the two cross support bases 18, and the four skidproof pads 20 to provide a steady support mechanism for the seat 12.

With reference to FIG. 2, the infant bouncer 10 further includes at least one flexible part 22 and at least one corresponding positioning structure 24. Each flexible part 22 is respectively disposed on a lateral surface of the support frame 14 for providing elastic force to the seat 12 so as to cause bouncing motion of the seat 12. The flexible part 22 is preferably made of silicone or urethane material, such as TPU of BASF or Hytrel of Dupont. In the preferred embodiment, Hytrel 3078 is adopted as the material of flexible part 22.

The positioning structure 24 connects the seat 12 and the flexible part 22 so as to position the seat 12 relative to the support frame 14. The positioning structure 24 includes a plurality of hollow pillars 26 (three in each side shown in FIG. 2) and a plurality of positioning pins 28 (three in each side shown in FIG. 2), and a plurality of positioning holes 30 (three in each side shown in FIG. 2) is correspondingly formed on the flexible part 22. Each positioning pin 28 passes through one of the plurality of positioning holes 30 on the flexible part 22 and is disposed through one of the plurality of hollow pillars 26. In such a manner, the seat 12 may be positioned relative to the support frame 14. In the following, assembly of the flexible part 22 and the support frame 14 on one lateral surface of the seat 12 according to the present invention will be described in detail. As for assembly of the flexible part 22 and the support frame 14 on the other lateral surface of the seat 12 having the same structure, the related description is therefore omitted herein.

Figure 3:
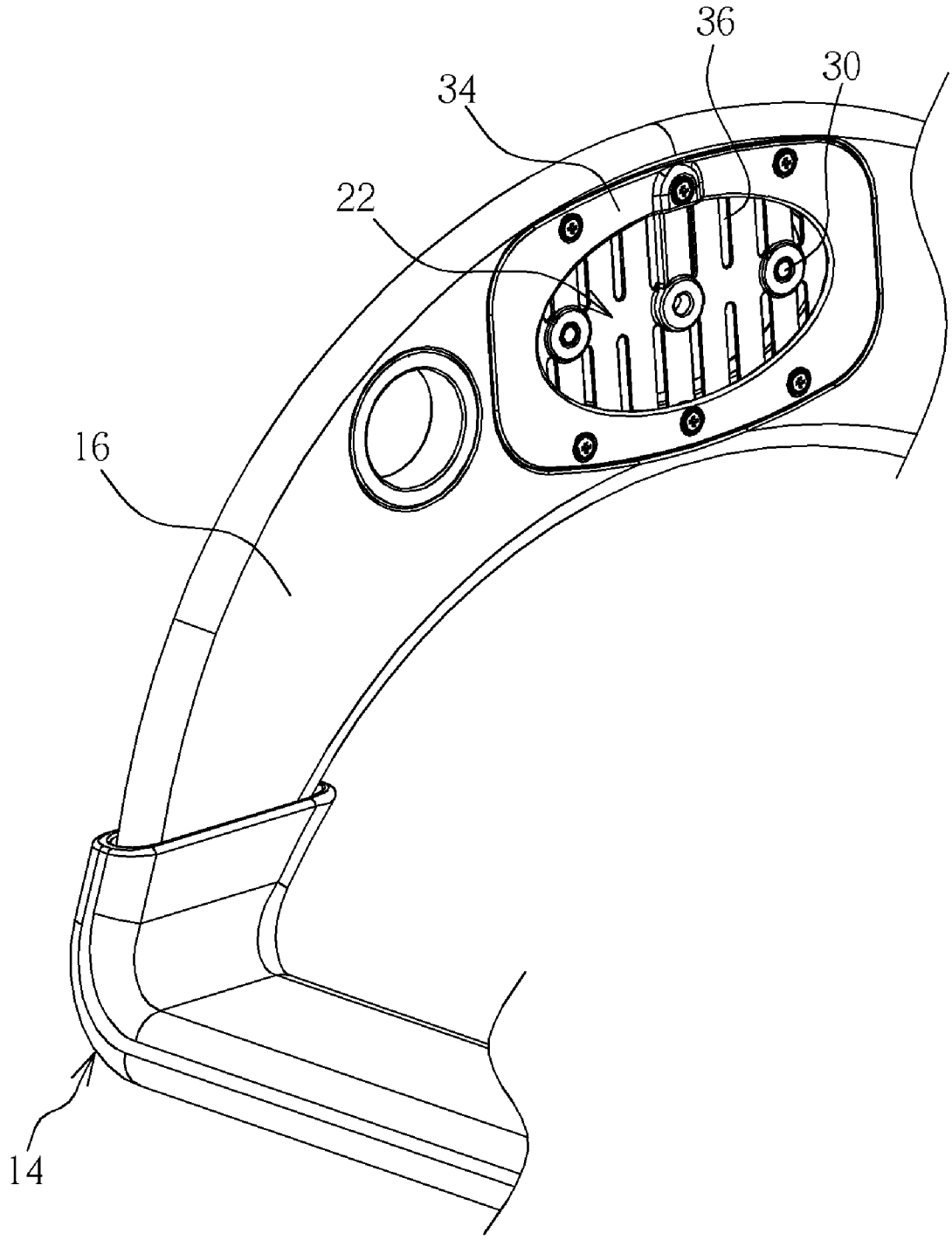
FIG. 3 is an assembly diagram of a support foot, a flexible part, and a fixing lid in FIG. 2 according to the first preferred embodiment of the present invention.

With reference to FIG. 2, an indentation 32 is preferably formed on the support foot 16 for containing the flexible part 22, and the infant bouncer 10 further includes a fixing lid 34 disposed at a side of the flexible part 22 for fixing the flexible part 22 to the support foot 16 of the support frame 14. In this embodiment, after the flexible part 22 is disposed in the indentation 32, the flexible part 22 can be fixed to the support foot 16 of the support frame 14 by the fixing lid 34 and screw as shown in FIG. 3, which is an assembly diagram of the support foot 16, the flexible part 22, and the fixing lid 34 in FIG. 2 according to the first preferred embodiment of the present invention. Furthermore, as shown in FIG. 2, a through hole 33 is preferably formed on the support foot 16 and connects the indentation 32. Thus, via the through hole 33, the flexible part 22 can be biased from the support point where the positioning structure 24 is connected to, so that the seat 12 can bounce back and forth, upward and downward, or in any direction.

A structural design for containing the flexible part 22 on the support foot 16 is not limited to the said structure. For example, the support foot 16 may only has the through hole 33 for containing the flexible part 22 without the indentation 32. As for the fixing method of the through hole 33 and the flexible part 22, the related description is omitted herein since it is commonly used in the prior art.

After the flexible part 22 is fixed to the support foot 16, the three positioning pins 28 can pass through the three positioning holes 30 on the flexible part 22, respectively, and then is disposed through the three hollow pillars 26, respectively. Furthermore, more positioning holes 30 can be formed and be arranged in different reclining positions on the flexible part 22. In such a manner, the seat 12 can be positioned at different angles relative to the support frame 14.

It should be noted that the connection design of the seat 12, the positioning structure 24, and the flexible part 22 is not limited to the aforementioned connection method. For example, the plurality of positioning holes 30 may be formed on the positioning structure 24 instead, and the flexible part 22 may include the plurality of positioning pins 28 correspondingly. In such a manner, after the flexible part 22 is fixed to the support foot 16, the positioning pins 28 on the flexible part 22 can pass through the positioning holes 30 on the positioning structure 24, respectively, so as to position the seat 12 relative to the support frame 14.

After assembly of the flexible part 22, the support frame 14, the positioning structure 24, and the seat 12 is completed, the seat 12 can bounce relative to the support frame 14 by elastic force produced by the flexible part 22. That is, if a baby care giver wants to cause bouncing motion of the seat 12, the baby care giver just needs to press the seat 12 relative to the support frame 14, so that the seat 12 can start to bounce relative to the support frame 14 automatically for helping the baby thereon fall asleep or feel comfortable. Additionally, because the flexible part 22 can be biased from the support point where the positioning structure 24 is connected to, the seat 12 can bounce back and forth, upward and downward, and in any direction as wish of the care giver.

With reference to FIG. 2, the flexible part 22 has a plurality of slits 36 thereon. These slits 36 can offer space for deformation of the flexible part 22, such that the seat 12 can bounce in greater range. Therefore the seat 12 can bounce more flexibly rather than stiffly.

It should be mentioned that the method for fixing the flexible part 22 to the support foot 16 is not limited to the said fixing method. For example, the flexible part 22 can also be directly disposed on the support foot 16 of the support frame 14 by screw without utilizing the fixing lid 34. In other words, the fixing lid 34 can be an optional part in the infant bouncer 10. Furthermore, number of the positioning pins 28 can vary with practical needs for the infant bouncer 10. For example, number of the positioning pins 28 can be increased to four or more for holding assembly of the seat 12 and the support frame 14 more firmly, and number of the positioning holes 30 on the flexible part 22 can be increased correspondingly.

Figure 4:
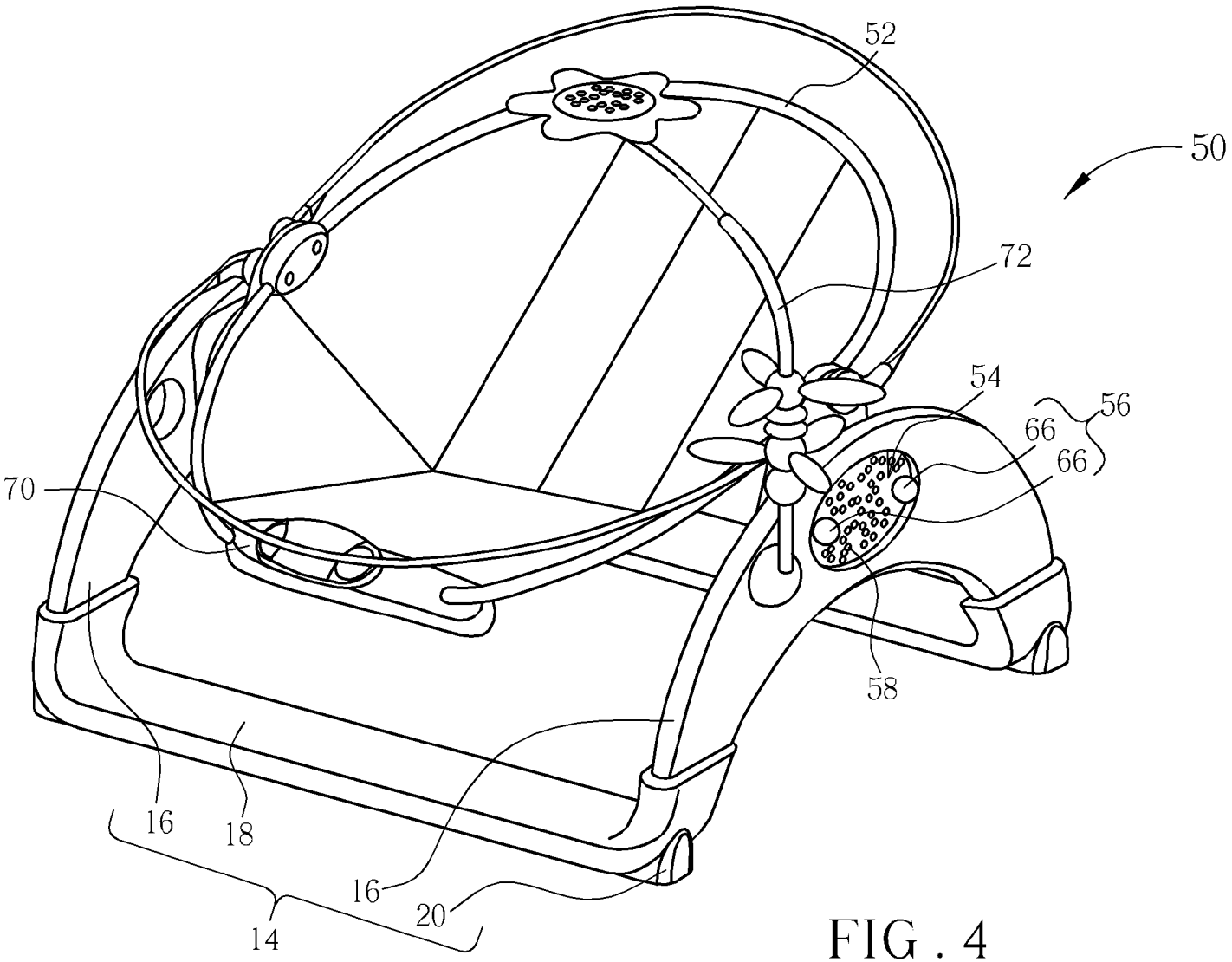
FIG. 4 is an assembly diagram of an infant bouncer according to a second preferred embodiment of the present invention.

Please refer to FIG. 4, which is an assembly diagram of an infant bouncer 50 according to a second preferred embodiment of the present invention. Components, functions and positions both mentioned in the first embodiment and the second embodiment represent similar components, functions and positions, and the related description is therefore omitted herein. Differences between the infant bouncer 10 and the infant bouncer 50 are the structural designs of the positioning structure and the flexible part. The infant bouncer 50 includes a seat 52 and the support frame 14. The support frame 14 is disposed for supporting the seat 52. With reference to FIG. 4, the infant bouncer 50 further includes at least one flexible part 54 and at least one corresponding positioning structure 56.

A plurality of cavities 58 is formed on the flexible part 54. Likewise, these cavities 58 offer the similar function of the slits 36 of the flexible part 22 in the first embodiment. That is, these cavities 58 can offer space for deformation of the flexible part 54, such that the seat 52 can bounce in greater range. Therefore the seat 52 can bounce more flexibly rather than stiffly. Each flexible part 54 is respectively disposed on a lateral surface of the support frame 14 for providing elastic force to the seat 52 so as to cause bouncing motion of the seat 52. The flexible part 54 is preferably made of silicone or urethane material, such as TPU of BASF or Hytrel of Dupont.

Figure 5:
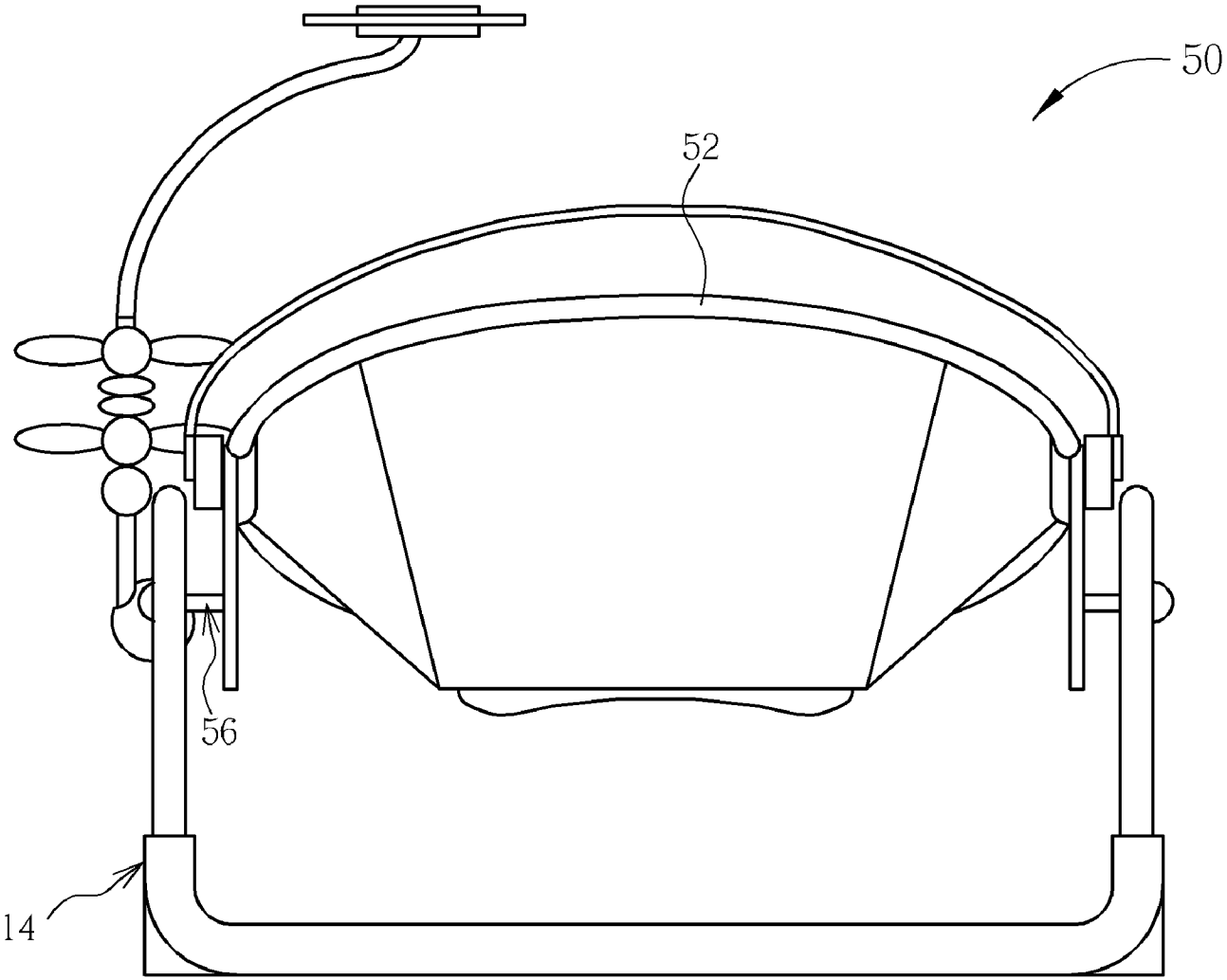
FIG. 5 is a back view of the infant bouncer in FIG. 4 according to the second preferred embodiment of the present invention.

Please refer to FIG. 4 and FIG. 5. FIG. 5 is a back view of the infant bouncer 50 in FIG. 4 according to the second preferred embodiment of the present invention. As shown in FIG. 4 and FIG. 5, the positioning structure 56 is connected to the seat 52 and passes through the flexible part 54 so as to position the seat 52 relative to the support frame 14. Likewise, the positioning structure 56 can be arranged that the seat 52 can retain in different angles relative to the support frame 14. In the following, assembly of the flexible part 54 and the support frame 14 on one lateral surface of the seat 52 according to the present invention will be described in detail. As for assembly of the flexible part 54 and the support frame 14 on the other lateral surface of the seat 52 having the same structure, the related description is therefore omitted herein.

Figure 6:
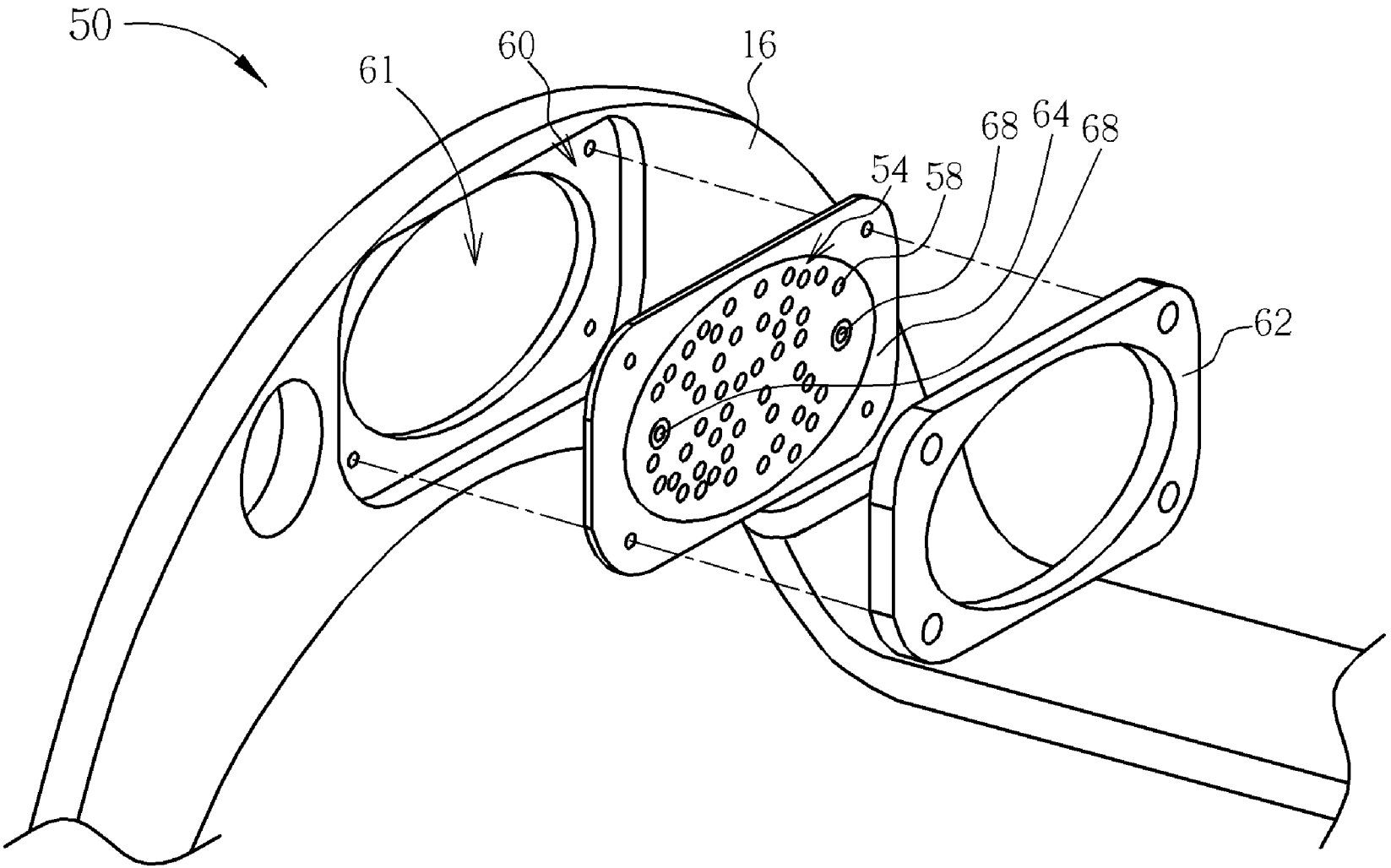
FIG. 6 is a partial exploded diagram of the infant bouncer in FIG. 4 according to the second preferred embodiment of the present invention.
Figure 7:
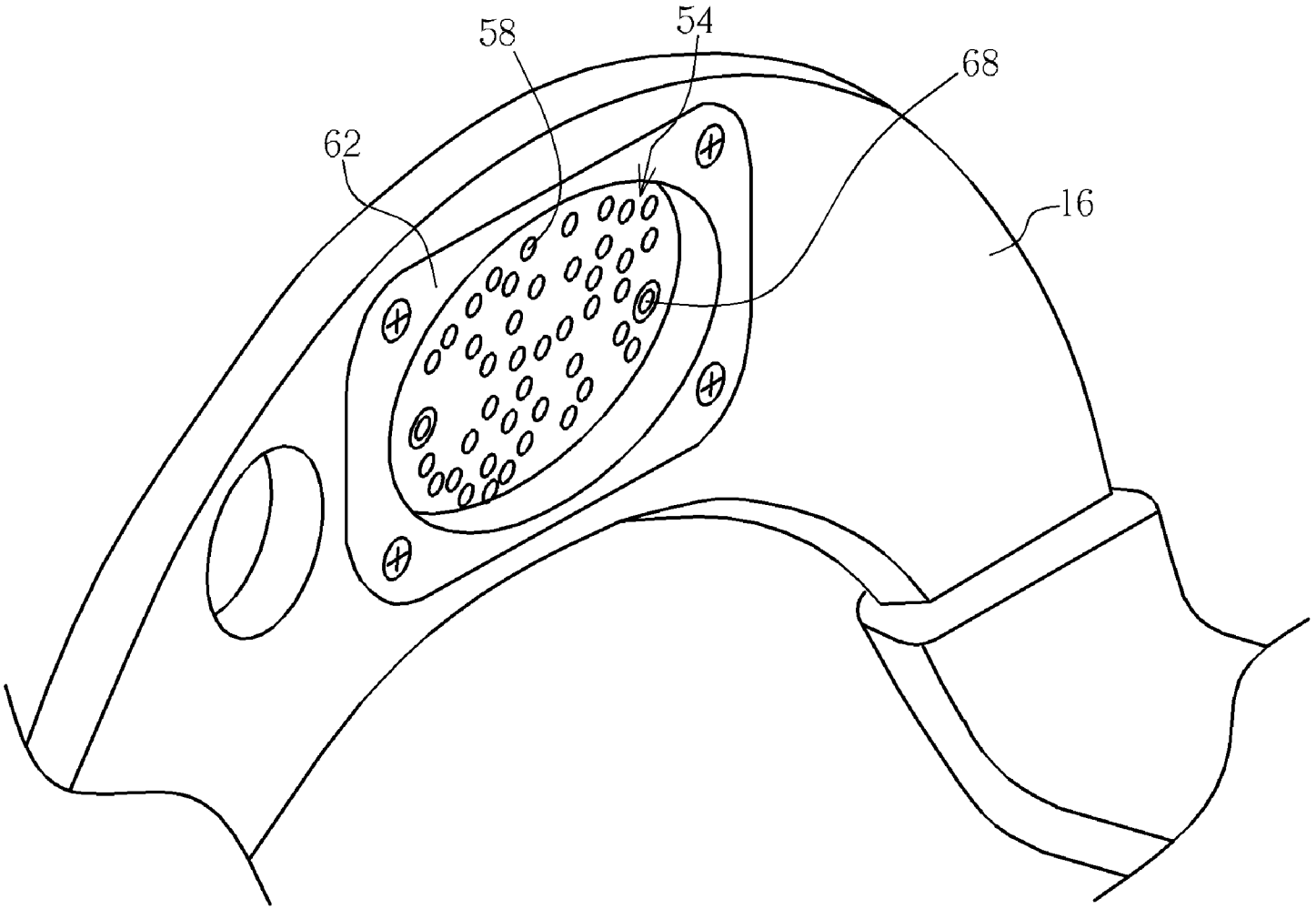
FIG. 7 is an assembly diagram of a support foot, a flexible part, and a fixing lid in FIG. 6 according to the second preferred embodiment of the present invention.

Please refer to FIG. 6, which is a partial exploded diagram of the infant bouncer 50 in FIG. 4 according to the second preferred embodiment of the present invention. As shown in FIG. 6, an indentation 60 is formed on the support foot 16 for containing the flexible part 54, and the infant bouncer 50 further includes a fixing lid 62 disposed at a side of the flexible part 54 for fixing the flexible part 54 to the support foot 16. In this embodiment, after the flexible part 54 is disposed in the indentation 60, the flexible part 54 can be fixed to the support foot 16 by the fixing lid 62 by screw as shown in FIG. 7, which is an assembly diagram of the support foot 16, the flexible part 54, and the fixing lid 62 in FIG. 6 according to the second preferred embodiment of the present invention. Furthermore, as shown in FIG. 6, a through hole 61 is formed on the support foot 16 and connects indentation 60. Thus, via the through hole 61, the flexible part 54 can be biased from the support point where the positioning structure 56 is connected to, so that the seat 52 can bounce back and forth, upward and downward, or in any direction. A structural design for containing the flexible part 54 on the support foot 16 is also not limited to the said structure. For example, the support foot 16 may only has the through hole 61 for containing the flexible part 54 without the indentation 60. As for the fixing method of the through hole 61 and the flexible part 54, the related description is also omitted herein since it is commonly used in the prior art.

Similarly, the method for fixing the flexible part 54 to the support foot 16 is also not limited to the said fixing method. For example, the flexible part 54 can also be directly disposed on the support foot 16 by screw without utilizing the fixing lid 62. In other words, the fixing lid 62 can be an optional part in the infant bouncer 50.

Please refer to FIG. 4 and FIG. 6. As shown in FIG. 6, for increasing the structural strength of the flexible part 54, a reinforcing plastic frame 64 can be formed with the flexible part 54 in an injection molding manner (e.g. being disposed around the flexible part 54 in an overmolding manner).

Furthermore, as shown in FIG. 4 and FIG. 6, the positioning structure 56 includes a plurality of positioning pins 66 (two shown in FIG. 4) and the flexible part 54 further includes a plurality of positioning holes 68 (two shown in FIG. 6). In such a manner, the two positioning pins 66 can respectively pass through the two positioning holes 68, so that the seat 52 can be positioned relative to the support frame 14.

After assembly of the flexible part 54, the support frame 14, the positioning structure 56, and the seat 52 is completed, the seat 52 can bounce relative to the support frame 14 by elastic force produced by the flexible part 54. That is, if a baby care giver wants to cause bouncing motion of the seat 52, the baby care giver just needs to press the seat 52 relative to the support frame 14 in any direction, and then release the seat 52, so that the seat 52 can start to bounce relative to the support frame 14 correspondingly for helping the baby thereon fall asleep or feel comfortable.

It should be mentioned that number of the positioning pins 66 can vary with practical needs for the infant bouncer 50. For example, number of the positioning pins 66 can be increased to three or more for holding assembly of the seat 52 and the support frame 14 more firmly, and number of the positioning holes 68 can be increased correspondingly. Furthermore, in the present invention, the positioning pins 66 can also be detachably disposed through the flexible part 54, and number of the positioning holes 68 may be increased correspondingly, wherein these positioning holes 68 can be formed and be arranged in different reclining positions on the flexible part 54. In such a manner, if a baby care giver wants to adjust the inclined angle of the seat 52 relative to the support frame 14, the baby care giver just needs to detach the positioning pins 66 from the positioning holes 68 that the positioning pins 66 currently pass through, and then dispose the positioning pins 66 through other positioning holes 68, so that the seat 52 can be positioned at a different inclined angle relative to the support frame 14.

Furthermore, as shown in FIG. 4, the infant bouncer 50 further includes a vibrating device 70 and a toy rod 72. The vibrating device 70 is preferably disposed at a front end of the seat 52 for soothing a baby sitting on the seat 52. The toy rod 72 is disposed at a side of the support frame 14 for allowing a baby sitting on the seat 52 to do some recreational activities. The vibrating device 70 and the toy rod 72 can also be optional parts in the infant bouncer 50. In addition, the disposal design of the vibrating device 70 and the toy rod 72 may also be applied to the infant bouncer 10.

Compared with the prior art, in which a sophisticated bouncing structure is utilized in an infant bouncer for causing bouncing motion of a seat of the infant bouncer, the present invention utilizes a flexible part disposed on a support frame of an infant bouncer in place of a traditional frame design so as to bounce in any direction. Thus, distinguished form a traditional bouncer, the preferred embodiments of the invention can offer more bouncing patterns. In other words, operation of the infant bouncer is novel and versatile in use.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant bouncer comprising:

a seat;

a support frame for supporting the seat;

a flexible part disposed on the support frame and having a plurality of positioning holes formed thereon; and a positioning structure connecting the seat and the flexible part, the positioning structure comprising a plurality of positioning pins for passing through the positioning holes so as to position the seat relative to the support frame.

2. The infant bouncer of claim 1, wherein the flexible part is disposed on a lateral surface of the support frame.

3. The infant bouncer of claim 1, wherein the flexible part is a flat plate.

4. The infant bouncer of claim 1, wherein the flexible part has a plurality of cavities.

5. The infant bouncer of claim 1, wherein the flexible part has a plurality of slits.

6. The infant bouncer of claim 1, wherein the positioning structure positions the seat relative to the support frame in different angles.

7. The infant bouncer of claim 1, wherein the support frame comprises two support feet respectively disposed at two sides of the seat, and one of the support feet has a through hole for containing the flexible part.

8. The infant bouncer of claim 1, wherein the support frame comprises two support feet respectively disposed at two sides of the seat, and one of the support feet has an indentation for containing the flexible part.

9. The infant bouncer of claim 8, wherein a through hole is formed on the support foot and connects the indentation.

10. The infant bouncer of claim 8, wherein each support foot is made of one of plywood, plastic material and the combination thereof.

11. The infant bouncer of claim 8, wherein the support frame further comprises at least one support base connected to the two support feet.

12. The infant bouncer of claim 1, wherein the flexible part is made of silicone or urethane material.

13. The infant bouncer of claim 1, wherein the positioning structure further comprises a plurality of hollow pillars disposed on the seat, and the positioning pins pass through the positioning holes and are engaged with the hollow pillars for positioning the seat.

14. The infant bouncer of claim 1 further comprising a fixing lid disposed at a side of the flexible part for fixing the flexible part between the support frame and the fixing lid.

15. The infant bouncer of claim 1, wherein the flexible part is connected to the support frame by a screw.

16. The infant bouncer of claim 1, wherein a reinforcing plastic frame is formed with the flexible part in an injection molding manner.

17. The infant bouncer of claim 16, wherein the reinforcing plastic frame is disposed around the flexible part in an overmolding manner.

18. An infant bouncer comprising:

a seat;

a support frame for supporting the seat;

a flexible part disposed on the support frame and comprising a plurality of positioning pins; and a positioning structure connecting the seat and the flexible part, the positioning structure having a plurality of positioning holes formed thereon, the positioning pins being used for passing through the positioning holes so as to position the seat relative to the support frame.

19. An infant bouncer comprising:

a seat;

a support frame comprising two support feet respectively disposed at two sides of the seat for supporting the seat, each of the support feet having a through hole formed thereon;

two flexible flat plates disposed inside the two through holes respectively; and a positioning structure connecting the seat and the two flexible flat plates to position the seat relative to the support frame, so that the seat is able to bounce in any direction via deformation of the two flexible flat plates.

20. The infant bouncer of claim 19, wherein each of the flexible flat plates is disposed on a lateral surface of the support frame.

21. The infant bouncer of claim 19, wherein a space for deformation is offered on each of the two flexible flat plates.

22. The infant bouncer of claim 21 wherein the space is offered by a plurality of cavities or a plurality of slits on each of the two flexible flat plates.

23. The infant bouncer of claim 19 further comprising two fixing lids respectively disposed at a side of each of the two flexible flat plates for fixing each of the two flexible flat plates between the support frame and the fixing lids.

24. The infant bouncer of claim 19, wherein each of the two flexible flat plates is made of silicone or urethane material.

25. The infant bouncer of claim 19, wherein two reinforcing plastic frames are respectively formed with the two flexible flat plates in an injection molding manner.

26. The infant bouncer of claim 25, wherein the two reinforcing plastic frames are respectively disposed around the two flexible flat plates in an overmolding manner.

* * * * *